US005641098A

United States Patent [19]

Roedhus et al.

[11] Patent Number: 5,641,098

[45] Date of Patent: Jun. 24, 1997

[54] SECURITY AND POURING STOPPER

[76] Inventors: Joergen Roedhus, Giliamshavevej 2, DK-9330 Dronninglund; Erik Schelde Petersen, Hedegaardsvej 29, DK-9440 Aabybro, both of Denmark

[21] Appl. No.: 492,109

[22] PCT Filed: Feb. 17, 1994

[86] PCT No.: PCT/DK94/00065

§ 371 Date: Aug. 10, 1995

§ 102(e) Date: Aug. 10, 1995

[87] PCT Pub. No.: WO94/19253

PCT Pub. Date: Sep. 1, 1994

[30] Foreign Application Priority Data

Feb. 18, 1993 [DK] Denmark ..... 93 00110
Sep. 27, 1993 [DK] Denmark ..... 1082/93

[51] Int. Cl.[6] ..... B65D 25/48

[52] U.S. Cl. ..... 222/481.5; 222/500

[58] Field of Search ..... 222/481, 479, 222/481.5, 482, 500, 544, 568, 569, 571; 137/38

[56] References Cited

U.S. PATENT DOCUMENTS

| | | | |
|---|---|---|---|
| 718,801 | 1/1903 | Strauss | 222/422 |
| 788,118 | 4/1905 | Perotti | 222/500 X |
| 927,195 | 7/1909 | Walton | 222/500 |
| 2,113,048 | 4/1938 | Gross | 222/482 |
| 2,300,053 | 10/1942 | Lubic | 222/481 |
| 2,828,054 | 3/1958 | Chiaramonte | 222/479 |
| 2,991,897 | 7/1961 | Burnett | 222/500 X |
| 3,152,712 | 10/1964 | Riess | 222/500 |
| 5,249,714 | 10/1993 | Merhar | 222/500 |

FOREIGN PATENT DOCUMENTS

| | | | |
|---|---|---|---|
| 0264181 | 4/1988 | European Pat. Off. . | |
| 343810 | 8/1904 | France . | |
| 555632 | 3/1923 | France . | |
| 1445696 | 6/1966 | France . | |
| 2646147 | 10/1990 | France | 222/500 |
| 2619990 | 11/1977 | Germany . | |
| 577207 | 5/1958 | Italy | 222/500 |

*Primary Examiner*—Andres Kashnikow
*Assistant Examiner*—Kenneth Bomberg
*Attorney, Agent, or Firm*—Watson Cole Stevens Davis, P.L.L.C.

[57] ABSTRACT

A security and pouring stopper is provided with a tubular channel (3) in which a ball (2) is situated which is able to move between two valve seats (6, 8). Next to the tubular channel (3) a radially outward chamber (10) is formed which is able to contain the ball (2) during ordinary pouring. The ball (2) has a diameter which is slightly less than the diameter of the tubular channel (3). If the bottle is overturned, the ball will be thrown or pressed through the tubular channel (3) to rest against the valve seat (8) situated at the outlet of the stopper. Here the ball will be stuck in friction or in a squeeze. When the stopper is subsequently to be made ready, the ball (2) is pressed free manually and then will place itself in position against the valve seat (6) next to the container (7) on which the stopper is mounted. The stopper will then be ready for use.

11 Claims, 1 Drawing Sheet

SECURITY AND POURING STOPPER

BACKGROUND OF THE INVENTION

The present invention relates to a security and pouring stopper that includes a tubular channel which contains a ball and which has a radially outward chamber in which the ball may be partly contained, the ball being retained in the channel.

Different types of pouring stoppers designed for bottles are known which make it possible to close off the contents of the bottle when not pouring. Such pouring stoppers may be opened and closed manually by means of lids or the like.

An example of a pouring stopper is disclosed in U.S. Pat. No. 3,152,712. This pouring stopper—when the bottle is in a normal upright position, closes the outlet and thus hinders evaporation, etc. In an ordinary pouring situation, the ball is able to position itself in a circumferential and radially-outwardly arranged chamber. In this manner liquid may run through the chamber past the ball. The stopper disclosed makes it possible to close the outlet if the bottle is placed upside down. However, the stopper will not function as a security stopper hindering liquid discharge if a bottle is overturned.

Another example of a stopper of the type mentioned above is known from European patent application No. 264,181. According to this application the stopper consists of a ball positioned in a recess in a bottle neck. The ball may be pressed in tightening contact in the bottle neck and thus ensure that a high pressure is maintained in the bottle. When the bottle is to be emptied of its contents, a manual pressure is conveyed to the ball which is consequently pressed down into the bottle neck, which is provided with a circumferential and radially-outwardly arranged chamber in which the ball is received while the content of the bottle is being poured out. However, this construction gives no security against unintended discharge if the bottle is overturned.

It is the object of the present invention to provide a security and pouring stopper which will allow easy and effortless pouring when a container, preferably a bottle, is to be emptied of its contents in an ordinary way and which will at the same time block any discharge when the container is overturned unintentionally.

SUMMARY OF THE INVENTION

According to the present invention this is achieved with a stopper of the type mentioned above which is characterized in that the inside of the tubular channel has a circular cross section with a diameter which is only slightly larger than the diameter of the ball, and that the ball is retained in the tubular channel by means of a valve seat in either end of the channel, of which at least the valve seat at the outlet of the channel is annular, and that the radial chamber has a size which is substantially equivalent to the half of the ball size, and that the chamber is positioned immediately above the ball when, in a resting position in use, it will in contact against the valve seat situated next to the container on which the stopper is mounted.

As the radial chamber is not a circumferentially-extending annular chamber, the ball will with high certainty pass the chamber when, in case of overturning the bottle, it is thrown through the tubular channel. Even in case of a relatively slow fall the closure is obtained because the ball will only roll into the radial chamber when the latter is directed substantially downwards while overturning the container and when the "overturning" occurs as a slow overturning. If an initial slow overturning occurs, the ball may also roll into the radial chamber, but at increased speed of overturning before the container falls, the ball may be thrown back out of the chamber and ensure the closure.

During ordinary pouring the ball will, upon initial pouring, roll into and remain retained in the radially outward chamber. The stopper will preferably be asymmetric with a spout so that the user will always pour with the spout turning forward towards the glass, cup, etc., into which the content of the container is to be poured. In this manner particularly high certainty is obtained that the ball will always position itself in the radially outward chamber. The radially outward chamber has a size which at least corresponds to half of the ball size. Thus, the ball will not be able to leave the radially outward chamber even when the container is being emptied in a position substantially with the bottom up.

In practice it has turned out that the ball will not be dragged out of the chamber during pouring from the container. It is assumed that a pressure increase occurs at the position of the ball in the tubular channel. Moreover, it is assumed that the pressure increase will help keep the ball in that position inside the radial chamber.

A closing effect during pouring is obtained in that the ball is thrown against the valve seat at the outlet of the channel. This may be achieved by means of an oblique thread-formed valve seat extending from a first point substantially at the end of the chamber next to the container and diametrically to the opposite side of the channel to a second point at a longer distance from the container than the first point. When ending the pouring, the container is rotated approx. 90°–180° so that the ball will leave the radial chamber and hit the annular valve seat, which will close the stopper. In practice it has turned out that the ball will be thrown forward and close with high certainty even if a container "overturns slowly".

In order to obtain a particularly secure positioning of the ball in the radial chamber, the chamber preferably has a less steep side turning toward the container while the opposite side is more steep so that particularly secure retainment of the ball inside the radial chamber is achieved.

When the bottle overturns, the ball will be thrown through the tubular channel and get in contact with the valve seat situated at the outlet of the stopper.

The stopper is preferably made of a flexible yielding material so that the ball will be wedged or squeezed in its position against the valve seat at the outlet. This means that the stopper may also be used for liquids with a content of a gas, e.g., carbon dioxide. By throwing the ball against the valve seat, a gas-proof closure is obtained so that the carbon dioxide or other gas is not released from the liquid.

As the tubular channel is only slightly larger than the diameter of the ball, it has surprisingly turned out that the ball will always be thrown out and come in contact with the valve seat when the bottle overturns. It is assumed that this effect is obtained because the ball does not risk losing its kinetic inertia owing to shock effects which might occur if during its movement forward the ball is thrown back and forth between opposed lateral walls in the channel.

The invention thus achieves that in case of an accident the ball will automatically block unintended discharge when the bottle overturns. At the same time the stopper may be used as a pouring stopper as the ball will, in ordinary use, be placed in the radially outward chamber. In order to ensure rapid flow of the bottle content during pouring, the stopper may advantageously be provided with a ventilation pipe extending from a position inside the channel to a point in the inside of the container.

When after pouring, or after being raised, a container is put in its normal position, the stopper will be situated with the tubular channel, oriented substantially vertically. Thus, the ball is able to fall down automatically into contact with the valve seat situated next to the container. In case the container has been overturned, manually freeing the ball from a friction hold or an elastic squeeze may be required. Thereafter the ball will automatically be returned to its point of departure allowing resumed pouring or making the stopper ready again as a security stopper that will block unintended discharge if the container is overturned.

After the return of the ball to the valve seat next to the container, remaining liquid in the tubular channel may place itself on top of or around the ball. In order to permit this liquid to pass into the container, there may be provided one or several small incisions in the valve seat permitting liquid flow past the ball.

By designing the stopper with an oblique front end and a bevel to form a spout, drops are prevented from running down on the outside of the stopper and the container. At the same time this will also permit unproblematic pouring since the ball is automatically located in the radial chamber situated in the same radial position as the spout.

It has turned out that the stopper may have a length of approx. 2 to 7 times the diameter of the ball, however, the best results are obtained with a stopper in which the tubular channel has a length that is approx. 3 to 4 times the diameter of the ball.

The invention will now be described in further detail with reference to the attached schematic drawings

DETAILED DESCRIPTION OF THE PREFERRED EMBODIMENTS

Figure 1:
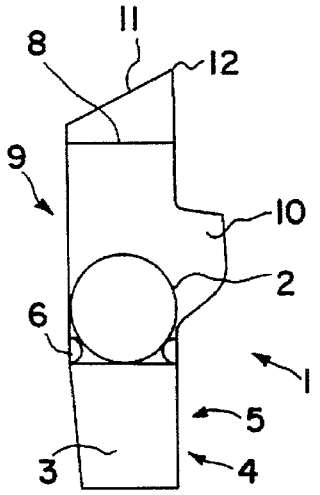
FIG. 1 shows a section view through a security and pouring stopper in a vertical position (the starting position), FIG. 2 a sectional view through a security and pouring stopper in ordinary use (pouring), FIG. 3 a sectional view through a security and pouring stopper in an accident (bottle is overturned)
Figure 3:
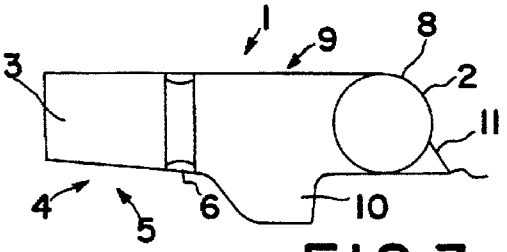
Figure 4:
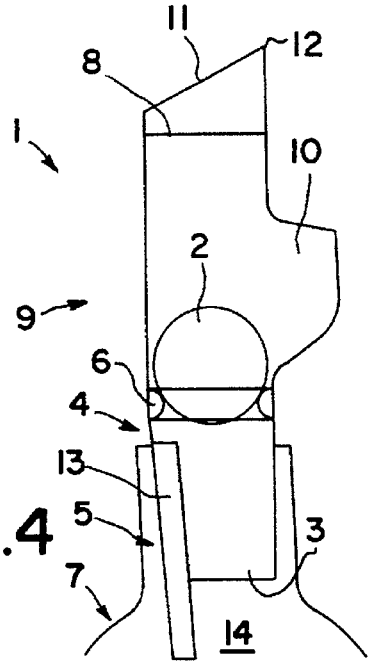
FIG. 4 illustrates the security and pouring stopper mounted on a bottle.

FIG. 1 shows a sectional view through a first embodiment of a security and pouring stopper according to the invention. The stopper 1 includes a ball 2 placed in a tubular channel 3 inside a tap 4. The tap or body 4 includes a conic portion 5 for fastening to a container, preferably a bottle. Inside the tubular channel 3 the ball 2 is provided for movement between the position shown in FIG. 1 and the position shown in FIG. 3. In FIG. 1 the ball rests against an annular valve seat 6 situated on the side of the channel turning towards the container, preferably a bottle 7 (see FIG. 4). In the other position illustrated in FIG. 3 the ball 2 rests against an annular valve seat 8 and will block unintended liquid flow through the tubular channel 3 in case the bottle 7 is overturned so that the ball 2 is thrown or pressed against the valve seat 8.

Figure 2:
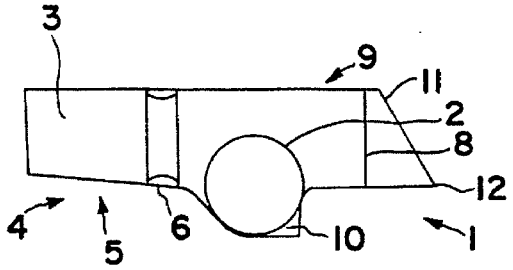

In the shown embodiment the ball 2 is manufactured from stainless steel and the tap 4 from a plastic material. The tap 4 is preferably produced from two different plastic materials. Thus, for the conic portion 5 it is preferred to use a soft plastic which will easily adapt to variations in the aperture of a bottle neck. In the remaining portion 9 of the tap 4 it is preferred to use a harder plastic material. Alternatively, it is possible to use other materials, it only has to be ensured that the ball has sufficient weight to be able to be thrown against the valve seat 8 and that the materials provide mutual tightening when the ball 2 is in a friction hold or a squeeze in the valve seat 8. Alternatively, the ball 2 may be covered with plastic. The stopper 1 may also be used for ordinary pouring. This is illustrated in FIG. 2. The tubular channel 3 is provided with a radially outward chamber 10. The chamber 10 has a size which approximately receives half of the ball 2. During ordinary pouring the ball 2 will roll slowly from its resting position against the seat 6 down into the chamber 10, permitting the liquid to pass through the tubular channel 3. The stopper 1 has preferably an obliquely cut from edge 11 with formation of a spout 12. The spout 12 is placed with the same radial position as the chamber 10 so that the user will always orient the chamber 10 turning towards the glass or the cup into which the pouring is done. In this manner particularly high certainty is achieved that during ordinary pouring the ball 2 will roll into the chamber 10. After use the ball will automatically roll back to rest against the valve seat 6 when the bottle 7 is placed in its upright position. In order to ensure rapid pouring, the stopper will be provided with a breather pipe 13 (see FIG. 4) extending from the tubular channel 3 to the inside 14 of the bottle 7.

When the bottle overturns, the ball 2 will be thrown or pressed against the front valve seat 8. The ball will get stuck and block unintended discharge. In order to ensure that the ball gets stuck in its position against the valve seat 8, the seat is designed with a slight rise so that a wedging effect is achieved due to the inertia of the ball 2. After accidents, the ball 2 is easily pressed free and will return to its position against the valve seat 6.

Figure 5:
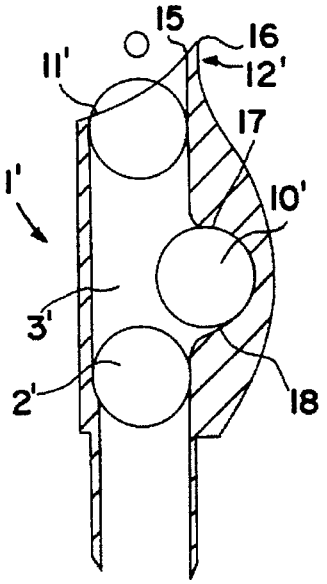
FIG. 5 shows a sectional view through a second and more detailed embodiment of a security and pouring stopper according to the invention.

FIG. 5 shows a further embodiment of a stopper 1' according to the invention like reference numerals referring to like parts from FIGS. 1–4. In FIG. 5 the stopper is composed of several assembled parts. However, the stopper 1' may also be produced from two assembled parts or moulded in one piece. The spout 12' is provided with a bevel 15 for the formation of a sharp edge 16 in the spout 12'. This ensures that liquid will run back in the tubular channel 3' and not down the outside of the stopper 1'.

The embodiment shown in FIG. 5 differs further from the embodiment shown in FIGS., 1–4 in the design of the radial chamber 10'. In the first embodiment the radial chamber was designed with walls 17, 18 having sharp edges at the side turning towards the bottle and the end turning towards the spout 12', respectively. In FIG. 5 the radial chamber 10' is designed with a shape which substantially corresponds to the shape of the ball. Furthermore, the wall 18 of the chamber wall is less steep than the wall 17 turning towards the spout 12. Thus, the ball 2' is able more easily to roll into the chamber 10' during ordinary pouring and is prevented from rolling out and stopping the flow even if the bottle 7 and thus also the stopper 1' are placed approximately with the bottom up for complete emptying of the content of the bottle 7.

Figure 6:
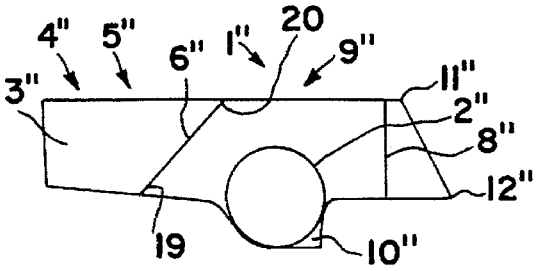
FIG. 6 shows a further embodiment of a stopper according to the invention.

FIG. 6 shows a further embodiment of a stopper 1" according to the invention. In FIG. 6" the valve seat 6 of the stopper, situated on the side of the channel turning towards the container, is formed by an oblique thread. The thread extends from a first point 19, approximately at the end of the radial chamber 10" which is next to the container, and diametrically to the opposite side of the channel 3" to a second point 20 situated at a greater distance from the container than the first point 19. When the stopper 1" is mounted on a container in a pouring position, the ball 2" is able to leave the radial chamber 10" if the container is rotated between 90° and 180°. As the ball 2" hits the obliquely extending valve seat 6", it will be guided to the front edge 11". In this manner the ball 2" will be pressed into contact with the annular valve seat 8" and close the stopper. The container may then be raised upright with a closed stopper. In practice it has turned out that during a slow overturn the ball 2" will be guided towards the valve seat 8" and ensure efficient closure of the stopper 1".

We claim:

1. A security and pouring stopper which comprises:

a body which provides a first end for attachment to a container, a second end remote from said first end, a tubular channel which extends from said first end to said second end, a radially-outwardly extending chamber which communicates with said tubular channel between said first end and said second end of said body, a first valve seat in said tubular chamber between said first end and said chamber and a second annular valve seat in said tubular channel between said chamber and said second end, and a ball which is movably positioned in said tubular channel between said first valve seat and said second valve seat and capable of being located in said chamber, wherein said tubular channel has a circular cross section which is slightly larger than a diameter of said ball, wherein said ball is sufficiently heavy that when thrown against said second valve seat it will wedge against said second valve seat and seal said tubular channel, and wherein said chamber has a size which is substantially equivalent to half said ball size.

2. A stopper according to claim 1, wherein the diameter of the tubular channel is between ½% and 5% larger than the diameter of the ball.

3. A stopper according to claim 1, wherein the ball is made of metal.

4. A stopper according to claim 1, wherein the body is made of an elastically flexible material which permits the ball to be pressed out for cleaning.

5. A stopper according to claim 1, wherein the radial chamber has a lateral wall extending towards the second end of the body which is steeper than a lateral wall turning towards the first end of the body.

6. A stopper according to claim 1, wherein the second end of the body is bevelled in order to form a spout with a sharp edge and provided in the same radial position as the radially outward chamber.

7. A stopper according to claim 6, wherein at the outlet the tubular channel has a substantially sloping direction so that the spout appears as a forward extension.

8. A stopper according to claim 1, wherein when resting on the first valve seat, the ball is at the same time located at a front edge of the radially outward chamber.

9. A stopper according to claim 1, wherein said first end of said body is conical in shape to provide a tap for insertion in a neck of a bottle.

10. A stopper according to claim 1, wherein the tubular channel has a length between two and seven times a diameter of the ball.

11. A stopper according to claim 3, wherein said metal is stainless steel.

* * * * *